US005189346A

United States Patent [19]

Branston et al.

[11] Patent Number: 5,189,346

[45] Date of Patent: Feb. 23, 1993

[54] GAS-DISCHARGE SWITCH

[75] Inventors: David-Walter Branston, Igelsdorf; Jan Stroh, Erlangen, both of Fed. Rep. of Germany

[73] Assignee: Siemens Aktiengesellschaft, Berlin & Munich, Fed. Rep. of Germany

[21] Appl. No.: 871,989

[22] Filed: Apr. 22, 1992

[30] Foreign Application Priority Data

Apr. 25, 1991 [EP] European Pat. Off. ..... 91106733.8

[51] Int. Cl.[5] ..... H01J 17/00; H01T 2/00

[52] U.S. Cl. ..... 315/326; 315/111.01; 313/306; 313/590

[58] Field of Search ..... 315/111.01, 326, 330, 315/334, 335, 337, 339; 313/231.41, 306, 581, 590

[56] References Cited

U.S. PATENT DOCUMENTS

| | | | |
|---|---|---|---|
| 4,939,416 | 7/1990 | Seeboeck et al. | 313/590 |
| 5,055,748 | 10/1991 | Reinhardt | 315/335 |
| 5,091,819 | 2/1992 | Christiansen et al. | 313/306 |
| 5,126,638 | 6/1992 | Dethlefsen | 315/326 |

OTHER PUBLICATIONS

G. N. Glasoe et al.: *Pulse Generator*, 1948, McGraw-Hill, New York, US; pp. 335-354.

IEEE Conference Record of the 1990 Nineteenth Power Modulator Symposium, Hyatt Islandia, San Diego, Calif., Jun. 26-28, 1990, P. Bickel et al.: "*High-Repetition Rate, Commercial Pseudospark Switches for Pulsed Modulators*", pp. 232-236.

Proc. VII Int. Conf. Phenom. in Ionized Gases, Belgrad, 1965, vol. 1, pp. 316-326, M. J. Schönhuber.

J. Phys. E: Sci. Instrum., vol. 19 (1986), pp. 466-470: *High repetition rate, fast current rise, pseudo-spark switch*, Mechtersheimer et al.

Japanese Journal of Applied Physics, vol. 29, No. 2, Feb. 1990, pp. L371-L374: The Pseudospark Switch—A High-Voltage Gas Discharge Switch for High-Power Applications, Axel Tinschmann et al.

*Primary Examiner*—Robert J. Pascal

*Attorney, Agent, or Firm*—Kenyon & Kenyon

[57] ABSTRACT

A gas-discharge switch contains at least two main electrodes for a low-pressure gas discharge. A distance d between the main electrodes and the pressure p of a working gas are selected so as to allow the igniting voltage to diminish with a rising product p×d. According to the present invention, a hollow electrode, which is connected to a trigger voltage source, is allocated to the discharge gap. The main electrode facing the hollow electrode is provided with a central opening. Between this opening and the hollow electrode, a baffle plate for the ion current flow of the low-pressure gas discharge is configured with a pre-set clearance from the surface of the main electrode.

10 Claims, 1 Drawing Sheet

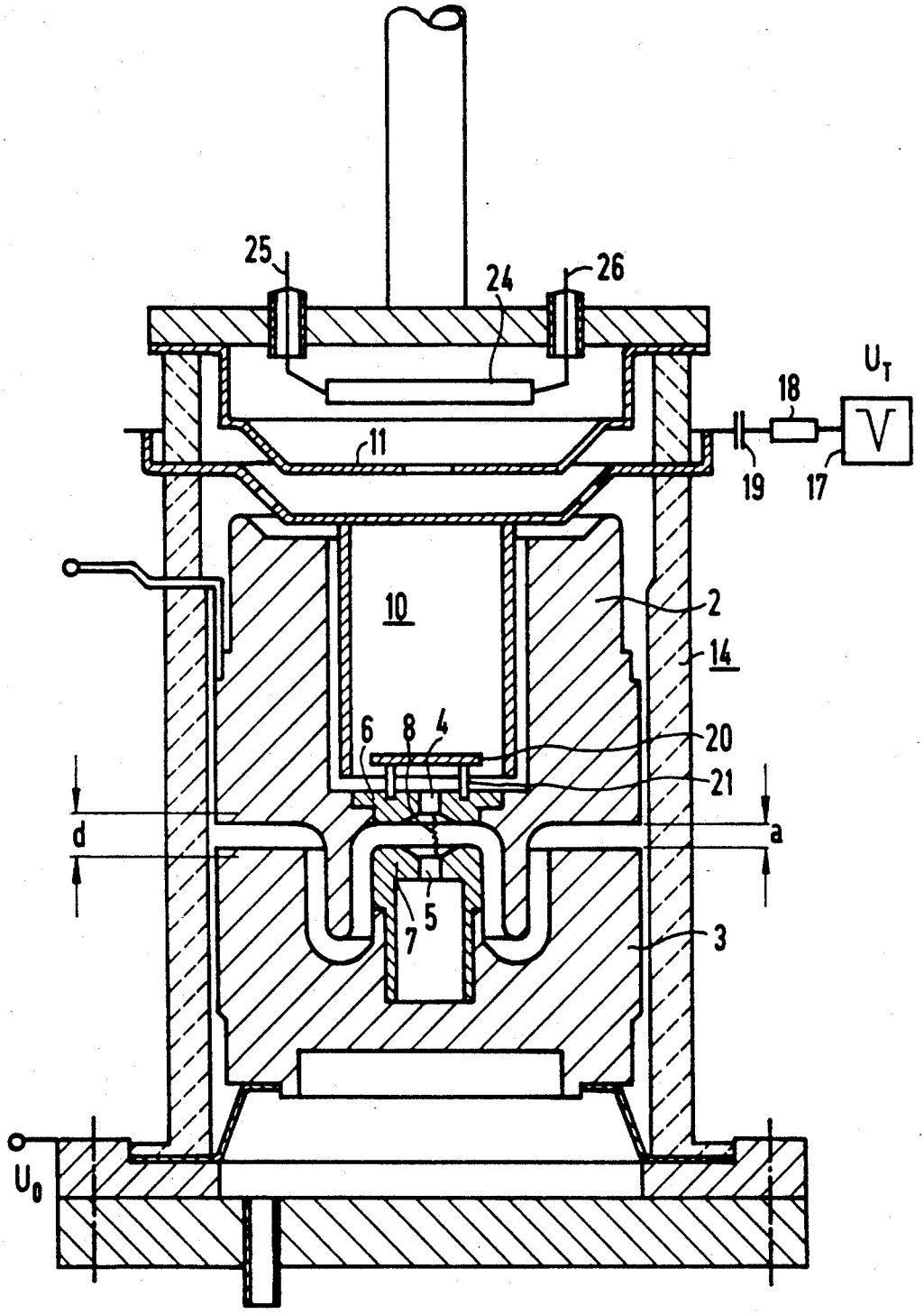
25
24
26
$U_T$
18
V
11
19
17
10
2
14
6
8
4
20
21
d
a
5
7
3
$U_0$

GAS-DISCHARGE SWITCH

BACKGROUND OF THE INVENTION

The present invention relates to a low pressure gas-discharge switch containing at least two main electrodes. These main electrodes are disposed at a distance d from each other in an arcing chamber and constitute one cathode and one anode of a discharge gap for the low-pressure gas discharge. The low pressure gas discharge is ignited by increasing the electron density in the rear cathode space. The arcing chamber contains an ionizable gas filling having a pressure p which is selected so as to allow the igniting voltage of the gas discharge to diminish as the product p×d (i.e., pressure×distance) increases.

The usual graphic representation of the gas-discharge gap's control characteristic, i.e., the dependance of its igniting voltage on the product of the gas pressure p and the electrode spacing (i.e., anode-to-cathode distance) d constitutes an important aid for characterizing electric discharge units when the firing probability is considered. When the dielectric strength of a given gas-discharge gap is determined, generally the infinitely large plate-type capacitor and its control characteristic are drawn upon for comparison. However, the practical specific embodiment of such discharge gaps has electrodes with finite dimensions. While determining the right branch of the iguitiou characteristic (Paschen curve) inclusive of the voltage minimum, merely arranging two flat, rounded-off plates, possibly provided at the edges with a so-called Rogowski profile, parallel to one another is sufficient. However, such an arrangement is useless for analyzing control characteristics in the left part of the Paschen curve, since indirect (i.e., diverted) discharges can occur.

Such indirect or diverted discharges can be avoided by using an electrode construction with flat plate electrodes disposed coaxially to one another, bent away from one another at their edges with a radius of curvature that is small relative to the electrode spacing, and supported along the inner cylindrical insulator surface. Thus, a gap is always formed between the bent, cylindrical edge area of the electrodes and the inner wall of the hollow-cylindrical insulator. This specific embodiment of a low-pressure gas-discharge gap enables the control characteristic to be determined, for example, for different inert and molecular gases in the near-strike range as well (i.e., left of the minimum of the Paschen curve) (see *Proc. VIIth Int. Conf. Phenom. in Ionized Gases*, Beograd 1965, vol. 1, pp. 316–326).

Gas-discharge switches controlled by a pulsed low-pressure gas discharge are also known. They operate at currents of 10 kA, for example, at a voltage of 20 kV. The discharge switch contains an anode and a cathode, each being provided with coaxial openings. Each are separated from one another at the edge by a ring-shaped insulator. A controlling device is provided for the gas discharge. It contains an electrode with a cage-like construction often described as a hollow electrode. The hollow electrode is connected in an electrically conductive manner to the cathode and is thus connected to the cathode potential. It encircles the rear cathode space and separates it from an area of a pre-ionization. The gas discharge between the cathode and the anode is fired by injecting charge carriers. The discharge gap is ignited in two steps: first a pre-ionization is produced by an auxiliary electrode through a glow discharge. Subsequently, a trigger electrode receives a negative firing pulse, and the entry of charge carries into the cage-type electrode is permitted because the potential of a blocking electrode is set to zero. The discharge is introduced with the entry of the charge carriers into the cage-type electrode (see *J. Phys. E: Sci. Instr.* 19 (1986), The Inst. of Physics, Great Britain, pp. 466–470 or *Jap. Journal of Appl. Phys.* 29 (1990) no. 2, part 2, Tokyo (JP), pp. L371–374).

SUMMARY OF THE INVENTION

The present invention seeks to simplify and improve the known specific embodiment of a gas-discharge switch for a low-pressure gas discharge. In particular, the present invention seeks to reduce the current flow to the hollow electrode so that the lifetime of the switch is increased.

The present invention attains the above mentioned goals by surrounding the rear cathode space by a hat-shaped control electrode. The control electrode has an opening which faces the discharge gap, and is separate from the allocated main electrode, and is connected to a trigger voltage source, whereby the main electrode facing the control electrode at the discharge gap is provided with an opening and a baffle plate for the ion beaui of the low-pressure gas discharge. The baffle plate is configured between the opening and the control electrode with a pre-determined clearance from the surface of the main electrode. The baffle plate is advantageously connected to the potential of the allocated main electrode and consequently protects the control electrode from the ions emerging from the opening of the main electrode. Preferably, the length of the baffle plate perpendicular to the axis of the opening is at least as great as the opening of the allocated main electrode. In addition, the baffle plate preferably consists of a material with a high melting point.

BRIEF DESCRIPTION OF THE DRAWING

The FIGURE is an exemplified embodiment of a gas-discharge switch schematically illustrated according to the present invention.

DETAILED DESCRIPTION

In the specific embodiment depicted in the FIGURE, the gas-discharge switch contains two main electrodes for a low-pressure gas discharge. One is operated as a cathode 2 and the other as an anode 3. The cathode 2 is provided with at least one opening 4 leading to a rear cathode space. In addition, the anode 3 can also be provided, correspondingly, with at least one opening 5 leading to a rear anode space. A discharge gap 8 can be ignited through the two openings 4 and 5. The cathode 2 and the anode 3 generally each form a rotating body. They are arranged with a pre-determined clearance a from one another, for example to about 2 to 5 mm. At the discharge gap 8, at least one of the surfaces of the cathode 2 and the anode 3 facing each other is provided with a tapered recess which widens the clearance between the electrodes 2 and 3 at the discharge gap 8. This clearance d can preferably amount to about 3 to 12 mm and more preferably at least 4 mm. The cathode 2 and the anode 3 consist essentially of electrically conductive material, preferably high-grade steel, and can generally also be provided at the discharge gap 8 with special inserts 6 and 7 of a high-fusion metal. Alternately, the cathode 2 and anode 3 can be made entirely of this high-fusion metal. Preferably, the diameter of the openings 4 and 5 is selected to be not more than and, in particular, smaller than the clearance d between the electrodes 2 and 3 at the discharge gap 8. The cathode 2 and the anode 3 are configured in an arcing chamber 14, whose hollow-cylindrical housing consists of electrically insulating material, preferably ceramic. A positive voltage $U_0$ of, for example, about 40 kV is to be applied to the anode 3.

A hat-shaped control electrode 10, having an opening, is configured in the arcing chamber 14 so as to allow its opening to face the discharge gap 8. The control electrode 10 is part of the trigger device for the discharge gap 8. The rear cathode space is surrounded, in particular, in the manner of a hollow body by the hat-shaped control electrode, therefore, the control electrode 10 is described in the following as a hollow electrode. The hollow electrode 10 consists of an electrically conductive material, for example high-grade steel, and at the least is shaped like a bowl, preferably a pot having a depth T which is greater than the length of the cathodic dark space of a glow discharge. A lateral, flange-type extension of the base 11 in the form of a profile ring is provided with openings to allow the admission of a working gas.

A trigger voltage source 17 with a trigger voltage $U_T$ is connected to the hollow electrode 10 and supplies a trigger pulse with a steep rising edge and a negative voltage of, for example, about 0.5 to 10 kV, preferably about 1 to 5 kV referred to the reference potential of the cathode 2, which can be ground for example. The length of the trigger pulse is at least as great as the switching delay of the discharge gap 8 and can amount, for example, to about 0.1 to 2.0 μs, preferably about 0.5 to 1.0 μs. The trigger voltage source 17 can preferably be connected via a limiting resistor 18 and a decoupling capacitor 19 to the hollow electrode 10.

By arranging a baffle plate 20, according to the present invention, between the opening 4 of the cathode 2 and of the hollow electrode 10, the ion beam of the low-pressure gas discharge can be prevented from impinging on the base 11 of the hollow electrode 10. Thus, corresponding wear to the hollow electrode 10 can be prevented. The baffle plate 20 is configured so that its flat sides are more or less perpendicular to the axis of the opening 4 and thus also more or less perpendicular to the discharge gap 8. It consists at least partially of electrically conductive material, preferably of a material with a high melting point. In particular, at least on its flat side facing the discharge gap 8, it can consist of molybdenum or tungsten. Furthermore, it can be made of an arc-resistant material, for example copper-chromium, which contains copper as a matrix and chromium, possibly with other additives as impregnating metal. It is connected in an electrically conductive manner to the cathode 2 and can be installed with a pre-set clearance above the bore hole 4 for example, via spacers 21 of electrically conductive material. The baffle plate 20, which acts as shield against the ions of the gas discharge, is thus essentially connected to the potential of the allocated main electrode (in this specific embodiment the main electrode is the cathode 2) and thus forces an earlier commutation to the cathode 2 as a result of the impingement of the ion beam during the discharge. The length of the baffle plate 20 perpendicular to the discharge gap 8 is at least as great as and preferably considerably greater than the inside width of the opening 4.

Generally, the arcing chamber 14 also contains a gas storage unit 24 for the working gas (indicated only schematically in the Figure). The gas storage unit is provided with a heating device (indicated only schematically in the Figure) and whose electrical terminals are denoted by 25 and 26 in the Figure.

The gas filling consists of an ionizable gas, preferably hydrogen or deuterium, or a mixture of these gases. Furthermore, nitrogen or inert gases, such as argon or helium are also suited.

What is claimed is:

1. A gas-discharge switch comprising:

a) a trigger voltage source;

b) an arcing chamber containing an ionizable gas filing;

c) a first main electrode, said first main electrode having a rear space, having an opening leading from a discharge gap to said rear space, and being disposed in said arcing chamber;

d) a second main electrode, said second main electrode being disposed in said arcing chamber with a discharge gap clearance (d) between said first main electrode and said second main electrode;

e) a hat-shaped control electrode, said control electrode surrounding said rear space of said first main electrode, having an opening facing the discharge gap, being separate from the first main electrode, and being connected to a trigger voltage source; and f) a baffle plate, said baffle plate being provided in said rear space of said first main electrode between said opening of said first main electrode and said hat-shaped control electrode at a predetermined distance from the surface of said first main electrode, wherein a low-pressure gas discharge is ignited by increasing the electron density in the said rear space of said first main electrode and wherein said ionizable gas filling of said arcing chamber has a pressure p selected so as to allow the igniting voltage of the low-pressure gas discharge to diminish as the product $p \times d$ increases.

2. The gas-discharge switch as claimed in claim 1 wherein the length of said baffle plate perpendicular to the axis of the opening of said first main electrode is at least as great as the breadth of the opening of the first main electrode.

3. The gas-discharge switch as claimed in claim 1 wherein the composition of said baffle plate includes a metal with a high melting point.

4. The gas-discharge switch as claimed in claim 2 wherein the composition of said baffle plate includes a metal with a high melting point.

5. The gas-discharge switch as claimed in claim 1 wherein the composition of said baffle plate consists essentially of a metal with a high melting point.

6. The gas-discharge switch as claimed in claim 2 wherein the composition of said baffle plate consists essentially of a metal with a high melting point.

7. The gas-discharge switch as claimed in claim 1 wherein the composition of said baffle plate includes tungsten.

8. The gas-discharge switch as claimed in claim 2 wherein the composition of said baffle plate includes tungsten.

9. The gas-discharge switch as claimed in claim 1 wherein the composition of said baffle plate includes molybdenum.

10. The gas-discharge switch as claimed in claim 2 wherein the composition of said baffle plate includes molybdenum.

* * * * *